US007850465B1

(12) United States Patent
Wan et al.

(10) Patent No.: US 7,850,465 B1
(45) Date of Patent: Dec. 14, 2010

(54) PLUG CONNECTOR WITH TWO ROWS OF SOLDERING SECTIONS

(75) Inventors: Wei Wan, Hsin-Tien (TW); Shu-Lin Duan, Hsin-Tien (TW); Ching-Tien Chen, Hsin-Tien (TW); Pin-Yuan Hou, Hsin-Tien (TW); Wen-Chih Ko, Hsin-Tien (TW)

(73) Assignee: Advanced Connectek Inc., Taipei Hsien (TW)

( * ) Notice: Subject to any disclaimer, the term of this patent is extended or adjusted under 35 U.S.C. 154(b) by 0 days.

(21) Appl. No.: 12/590,640

(22) Filed: Nov. 12, 2009

(30) Foreign Application Priority Data

Sep. 16, 2009 (TW) ..... 98131178 A

(51) Int. Cl.
*H01R 12/00* (2006.01)

(52) U.S. Cl. ..... 439/79; 439/607.4; 439/83

(58) Field of Classification Search ..... 439/78, 439/79, 83, 607.01, 607.31–607.4
See application file for complete search history.

(56) References Cited

U.S. PATENT DOCUMENTS

| | | | | |
|---|---|---|---|---|
| 7,367,818 | B2 * | 5/2008 | Sakamoto | 439/79 |
| 7,607,947 | B1 * | 10/2009 | Ho | 439/607.36 |
| 7,670,150 | B2 * | 3/2010 | Hisamatsu et al. | 439/79 |
| 7,748,997 | B2 * | 7/2010 | Hamner et al. | 439/79 |

* cited by examiner

*Primary Examiner*—Khiem Nguyen
(74) *Attorney, Agent, or Firm*—William E. Pelton, Esq.; Cooper & Dumham LLP

(57) ABSTRACT

A plug connector has an insulative housing, a mounting bracket, multiple first terminals, multiple second terminals and a shell. The mounting bracket is mounted on the insulative housing. The first terminals are mounted through the insulative housing and have soldering sections arranged in a first transverse row. The second terminals are mounted through the mounting bracket and have soldering sections arranged in a second transverse row. The soldering sections arranged in the different rows reduce a density of a soldering section layout and facilitate soldering the plug connector to a PCB.

12 Claims, 11 Drawing Sheets

PLUG CONNECTOR WITH TWO ROWS OF SOLDERING SECTIONS

BACKGROUND OF THE INVENTION

1. Field of the Invention

The present invention relates to a connector, and more particularly to a plug connector that has two rows of soldering sections of terminals to reduce a density of a soldering section layout to facilitate a soldering process and improve a production rate of the plug connector.

2. Description of Related Art

Conventional Universal Serial Bus (USB) 2.0 connectors are popularly used in various electronic devices. However, USB 2.0 protocol only allows a maximum transmission speed of 480 Mbps. Because electronic devices are constantly developed to increase transmission speeds, the USB 2.0 protocol does not meet current transmission speed requirement of new electronic devices. Therefore, the USB Implementers Forum (USB IF) established USB 3.0 protocol, with a theoretical maximum transmission speed of 5 Gbps.

However, a USB 3.0 connector having two rows of terminals is structurally complicated so manufacturing a USB 3.0 connector is difficult. Because almost double a number of terminals is required in comparison to a conventional connector, soldering sections of the terminals are packed more tightly so impeding soldering the soldering sections on a printed circuit board (PCB). Such tight packing also risks short circuit caused by excess solder connecting two adjacent terminals. Therefore, the USB 3.0 connector has a low production rate and high manufacturing cost.

To overcome the shortcomings, the present invention provides a plug connector with two rows of soldering sections to mitigate or obviate the aforementioned problems.

SUMMARY OF THE INVENTION

The main objective of the invention is to provide a plug connector that has two rows of soldering sections of terminals to reduce a density of a soldering section layout to facilitate a soldering process and improve a production rate of the plug connector.

A plug connector in accordance with the present invention has an insulative housing, a mounting bracket, multiple first terminals, multiple second terminals and a shell. The mounting bracket is mounted on the insulative housing. The first terminals are mounted through the insulative housing and have soldering sections arranged in a first transverse row. The second terminals are mounted through the mounting bracket and have soldering sections arranged in a second transverse row. The soldering sections arranged in the different rows reduce a density of a soldering section layout and facilitate soldering the plug connector to a PCB.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
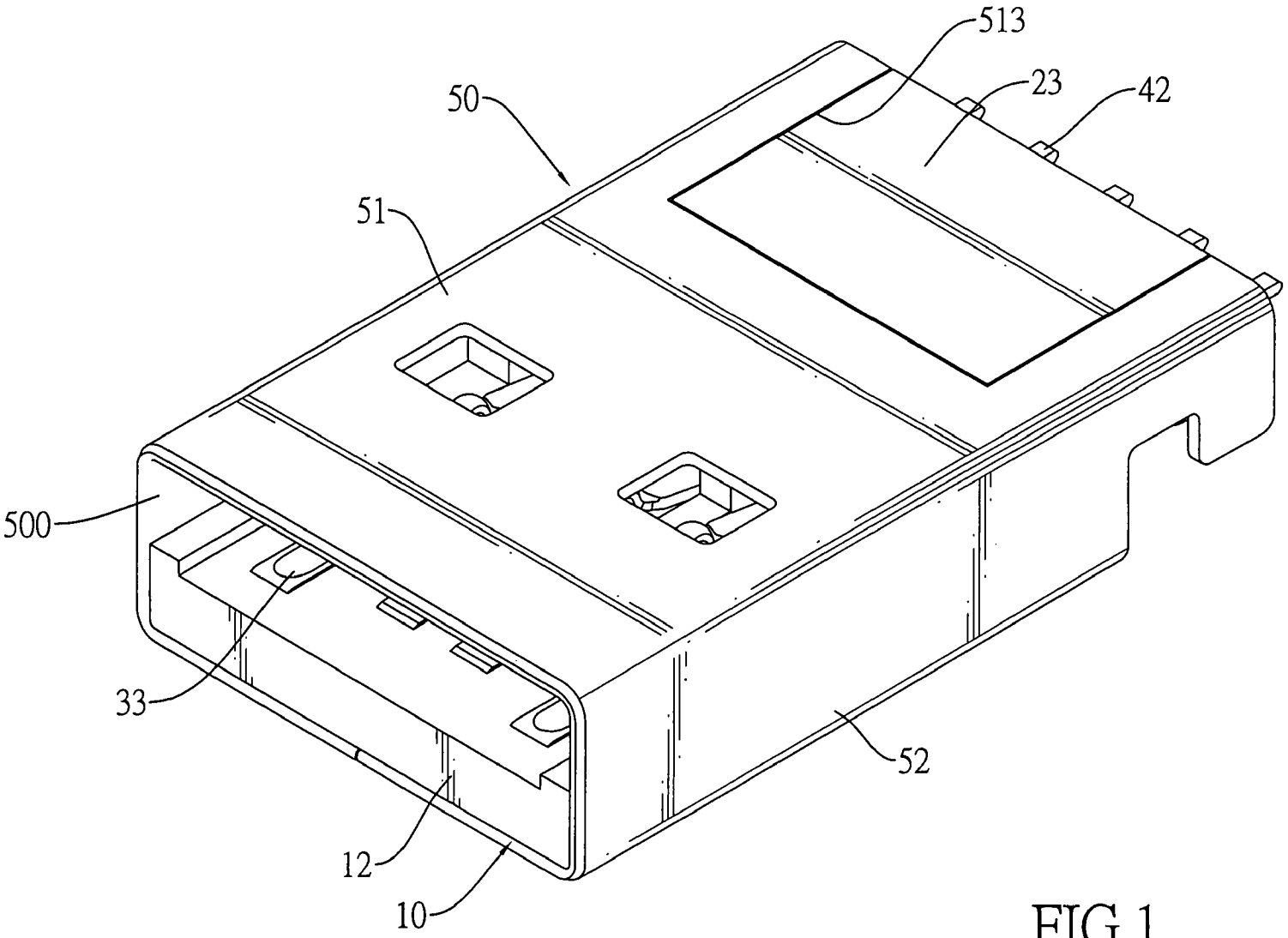
FIG. 1 is a front perspective view of a first embodiment of a plug connector with two rows of soldering sections in accordance with the present invention.
Figure 2:
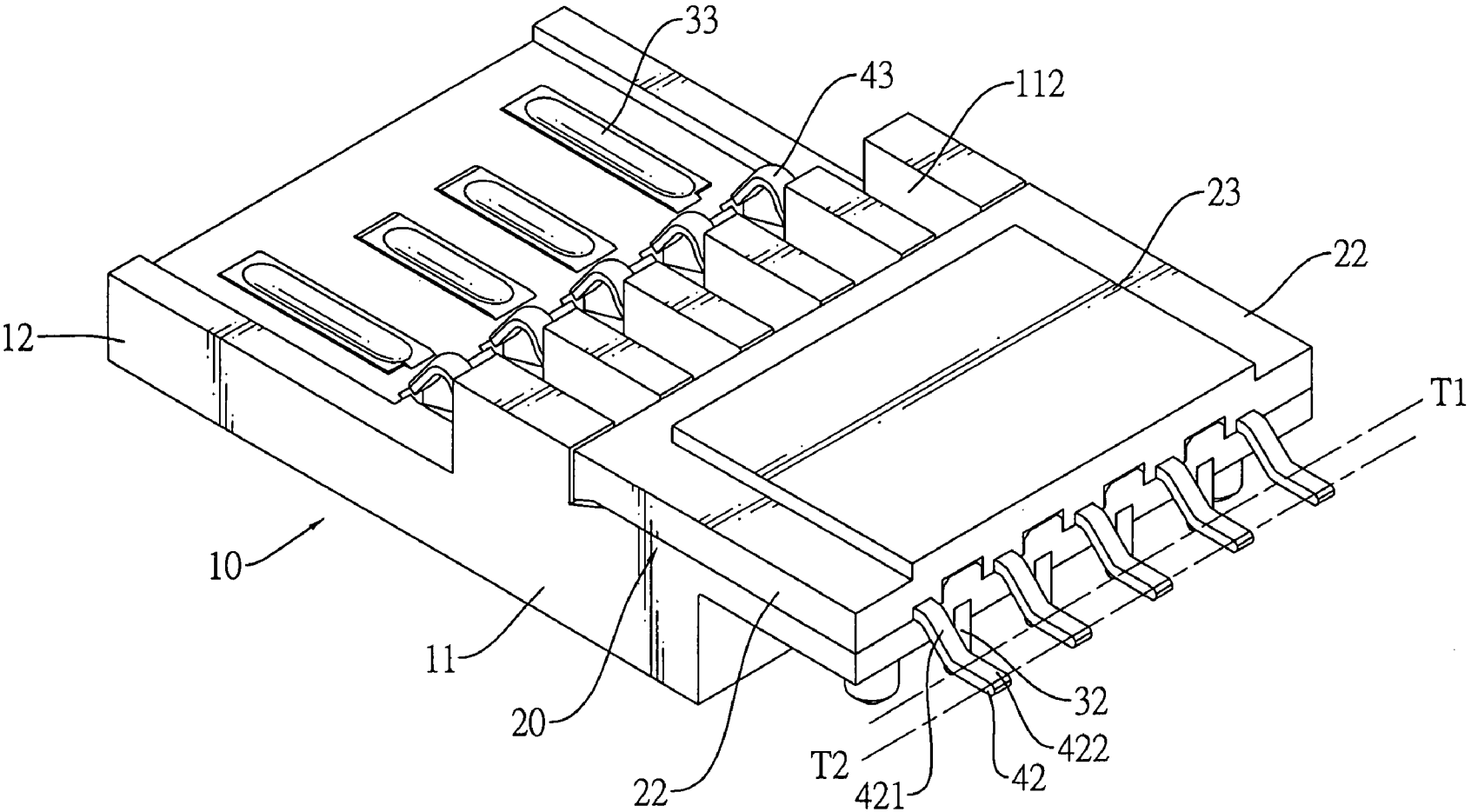
FIG. 2 is a rear perspective view of the plug connector in FIG. 1 omitting a shell.
Figure 3:
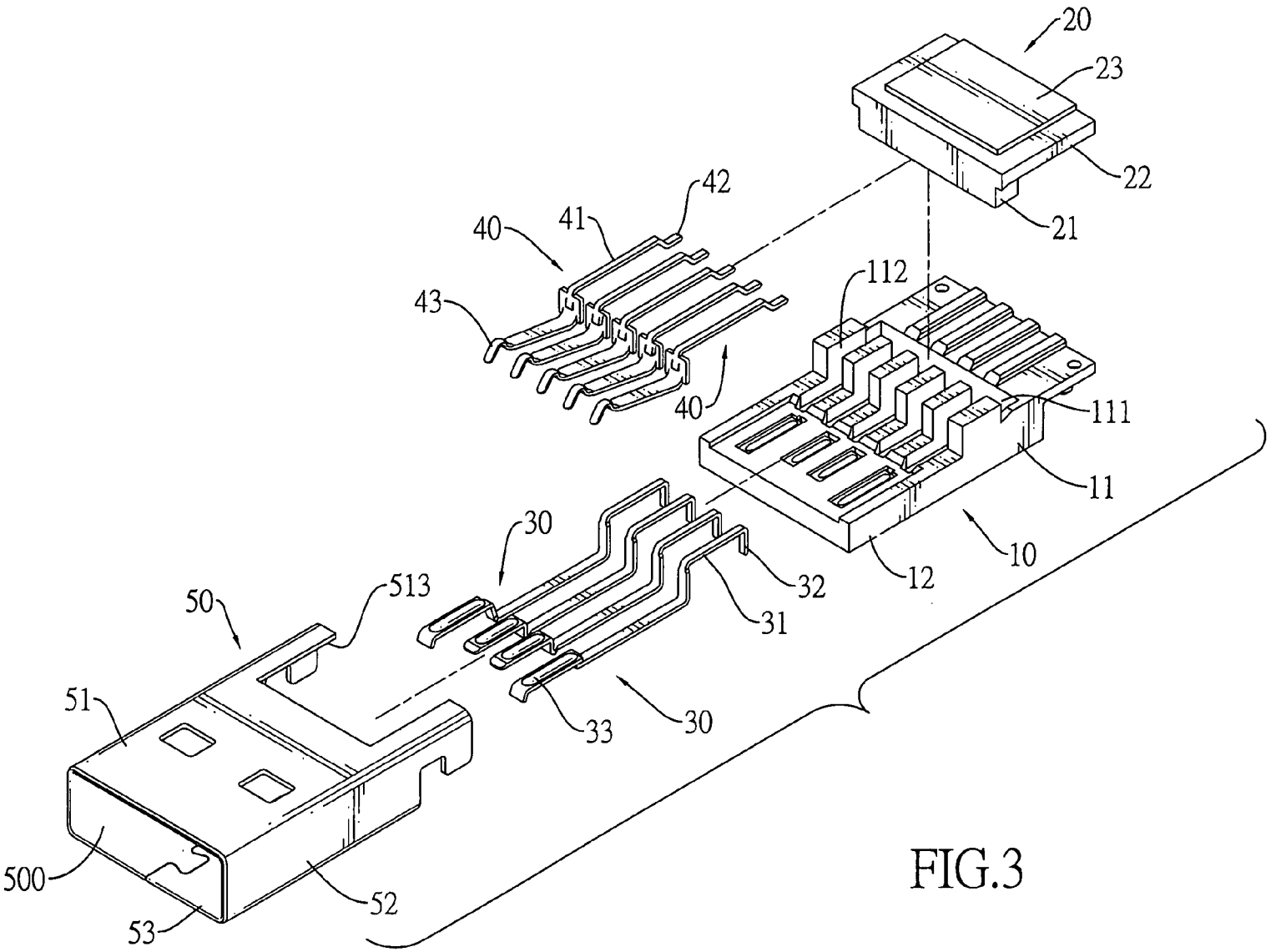
FIG. 3 is an exploded front perspective view of the plug connector in FIG. 1.
Figure 4:
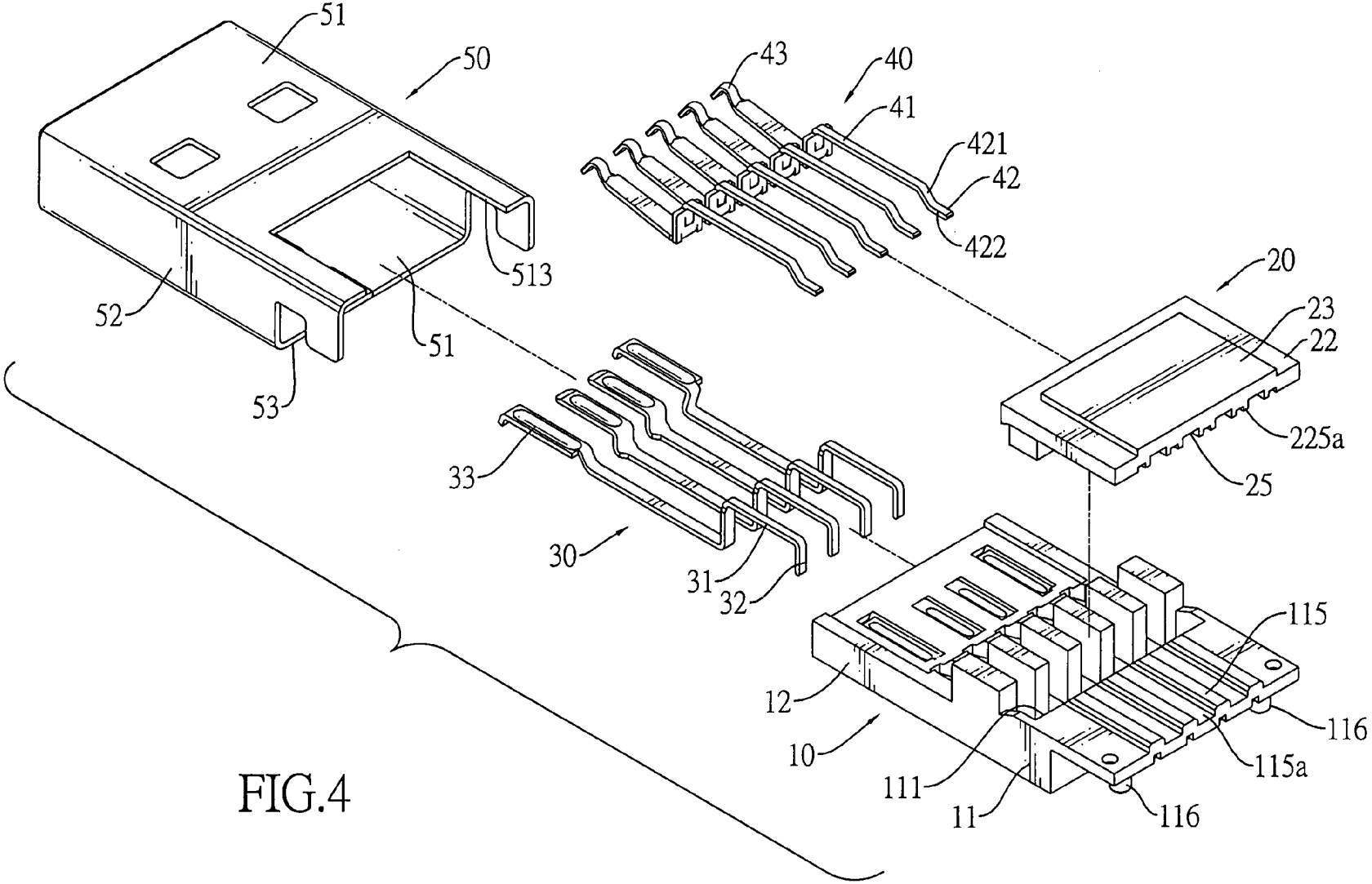
FIG. 4 is an exploded rear perspective view of the plug connector in FIG. 1.

With reference to FIGS. 1 to 4, a plug connector in accordance with the present invention may comply with type-A USB 3.0 plug connector standards and may be mounted on or connected to an electronic device, such as a flash memory storage device, and connected electrically to a PCB therein.

The plug connector comprises an insulative housing (10), a mounting bracket (20), multiple first terminals (30), multiple second terminals (40) and a shell (50).

Figure 5:
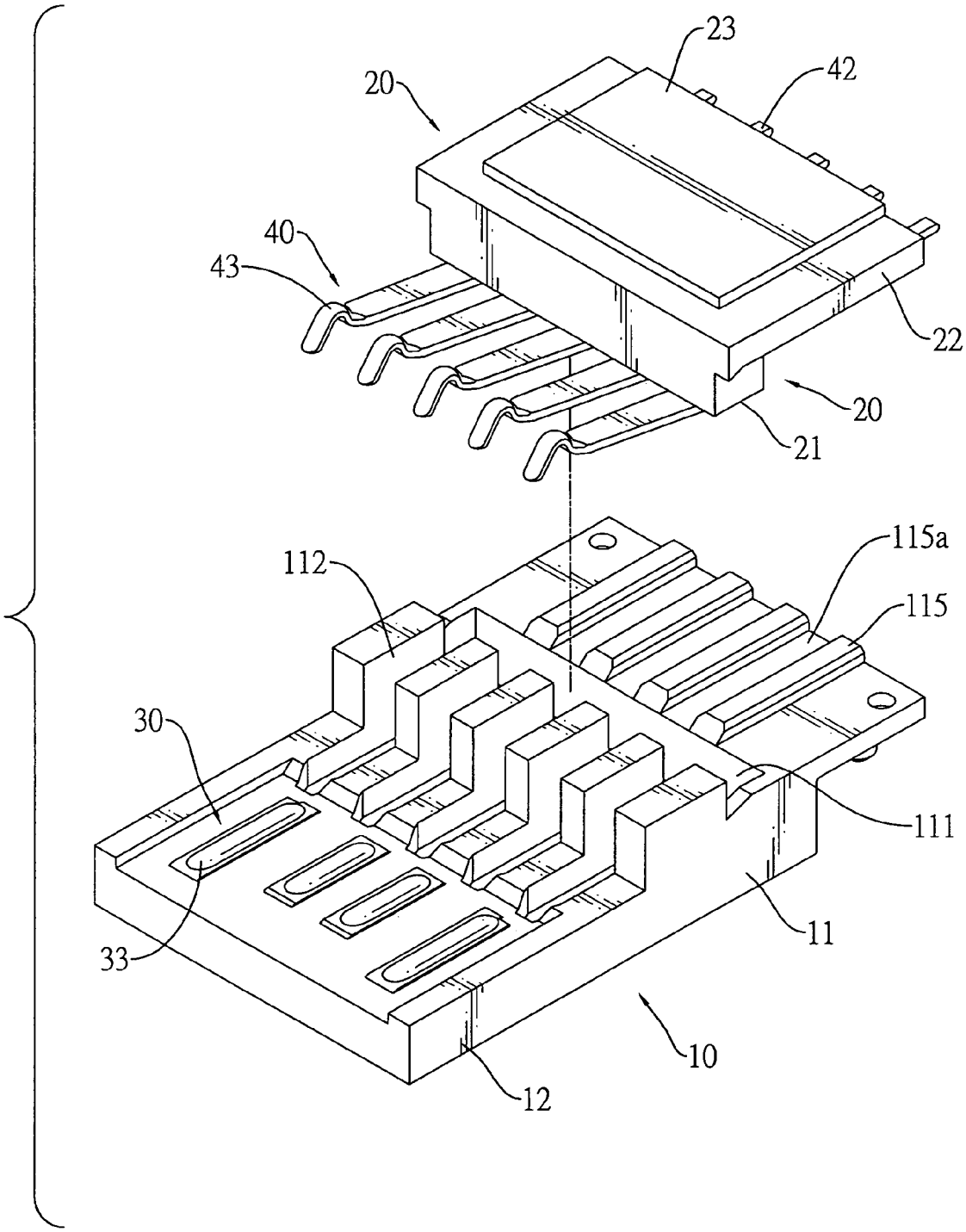
FIG. 5 is a partially exploded perspective view of the insulative housing and the mounting bracket of the plug connector in FIG. 1.

With further reference to FIG. 5, the insulative housing (10) has a base (11) and a tongue (12).

The base (11) has a top, a bottom, a front end and a rear end and may further have a mounting slot (111), multiple first engaging elements, multiple positioning notches (112) and multiple mounting posts (116). The mounting slot (111) is defined in the top of the base (11). The first engaging elements are formed on the top of the base (11) and may be multiple first notches (115*a*) and first ribs (115) arranged alternately. The positioning notches (112) are defined in the base (11). The mounting posts (116) are formed on the bottom of the base (11) and may be mounted respectively in mounting holes of a PCB.

The tongue (12) is formed on and protrudes forward from the front end of the base (11).

The mounting bracket (20) is a separate component from the insulative housing (10), is mounted on the insulative housing (10) and has a mount (21) and an extension member (22).

The mount (21) is mounted in the mounting slot (111) and has a rear end.

The extension member (22) is formed on and protrudes backward from the rear end of the mount (21), has a top surface and a bottom surface and may further have multiple second engaging elements and a fastening protrusion (23). The second engaging elements are formed on the bottom surface, respectively engage the first engaging elements and may be multiple second ribs (225*a*) and multiple second notches (225) respectively engaging the first notches and ribs (115*a*, 115) of the insulative housing (10). The fastening protrusion (23) is formed on and protrudes upward from the top surface.

The first terminals (30) are mounted through the insulative housing (10) by an insert-molding process and each first terminal (30), may be capable of implementing USB 2.0 signal transmission and has a mounting section (31), a soldering section (32) and a contacting section (33).

The mounting section (31) is mounted in the insulative housing (10).

The soldering section (32) is formed on and protrudes downward from the mounting section (32) and may extend out of the rear end of the base (11). The soldering sections (32) of the first terminals (30) are arranged in a first transverse row (T1) relative to the insulative housing (10).

The contacting section (33) is formed on and protrudes forward from the mounting section (31) and may be mounted on the tongue (12).

The second terminals (40) are mounted through the mounting bracket (20) by an insert-molding process, may be capable of cooperating with the first terminals (30) to implement USB 3.0 signal transmission and may be respectively mounted in the positioning notches (112) of the insulative housing (10). Each second terminal (40) has a mounting section (41), a soldering section (42) and a contacting section (43).

The mounting section (41) is mounted in the mounting bracket (20).

The soldering section (42) is formed on and protrudes downward from the mounting section (41). The soldering sections (42) of the second terminals (40) are arranged in a second transverse row (T2) relative to the insulative housing (10). The first transverse row (T1) is closer to the rear end of the base (11) of the insulative housing (10) than the second transverse row (T2).

The contacting section (43) is formed on and protrudes forward from the mounting section (41).

The shell (50) covers the insulative housing (10), mounting bracket (20), first terminals (30) and second terminals (40) and has a cavity (500), a top panel (51), two opposite side panels (52) and a bottom panel (53).

The cavity (500) is defined through the shell (50) and may hold a tongue of a corresponding socket connector.

The top panel (51) has a rear end and a fastening slot (513) defined in the rear end and engaging the fastening protrusion (23) of the mounting bracket (20) to prevent the shell (10) from being detached inadvertently from the insulative housing (10) the mounting bracket (20).

The side panels (52) are formed on and protrude downward from the top panel (51).

The bottom panel (53) is formed between the side panels (52).

Figure 6A:
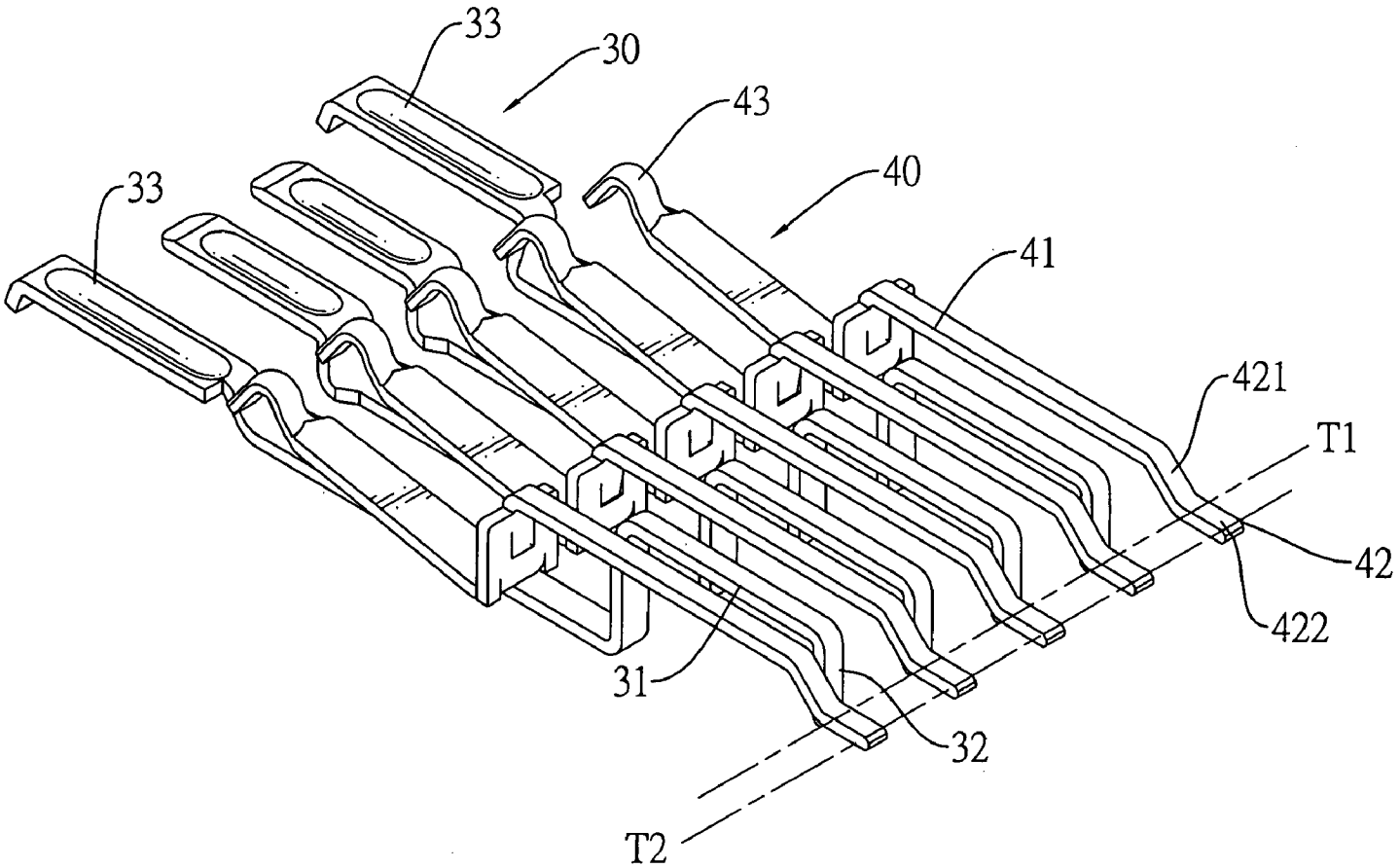
FIG. 6A is a perspective view of first and second terminals of the plug connector in FIG. 1.

With further reference to FIG. 6A, a first embodiment of the plug connector in accordance with the present invention has soldering sections (32) of the first terminals (30) being through hole technology (THE) type and straight so that the soldering sections (32) extend through soldering holes of a PCB. The soldering sections (42) of the second terminals (40) are surface mount technology (SMT) type and each soldering section (42) is substantially L-shaped and has an inclined segment (421) and a level segment (42). The inclined segment (421) protrudes obliquely downward from the mounting section (41). The level segment (422) protrudes horizontally backward from the inclined segment (421) and may be soldered on a PCB.

Figure 6B:
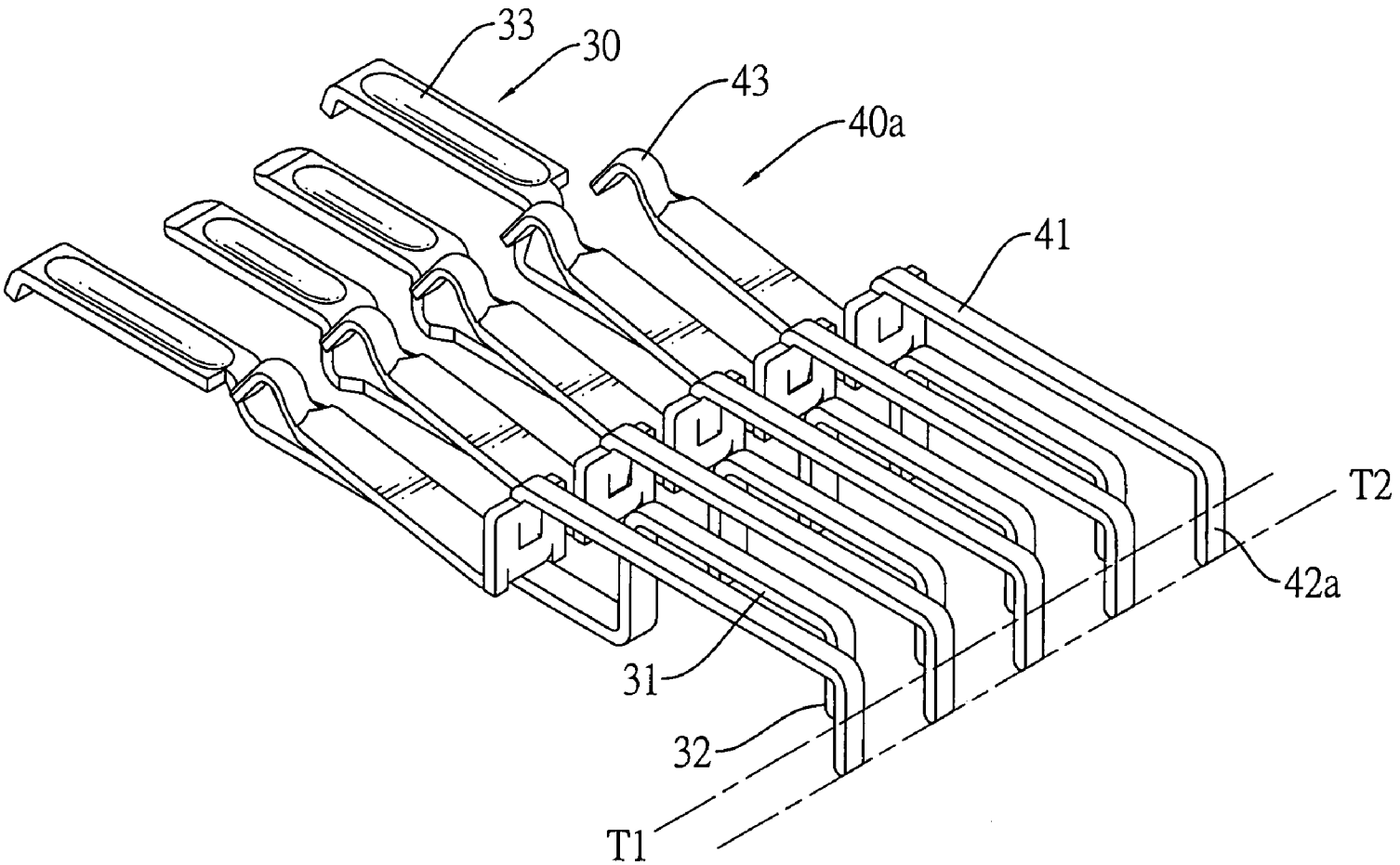
FIG. 6B is a perspective view of first and second terminals of a second embodiment of a plug connector with two rows of soldering sections in accordance with the present invention.
Figure 7:
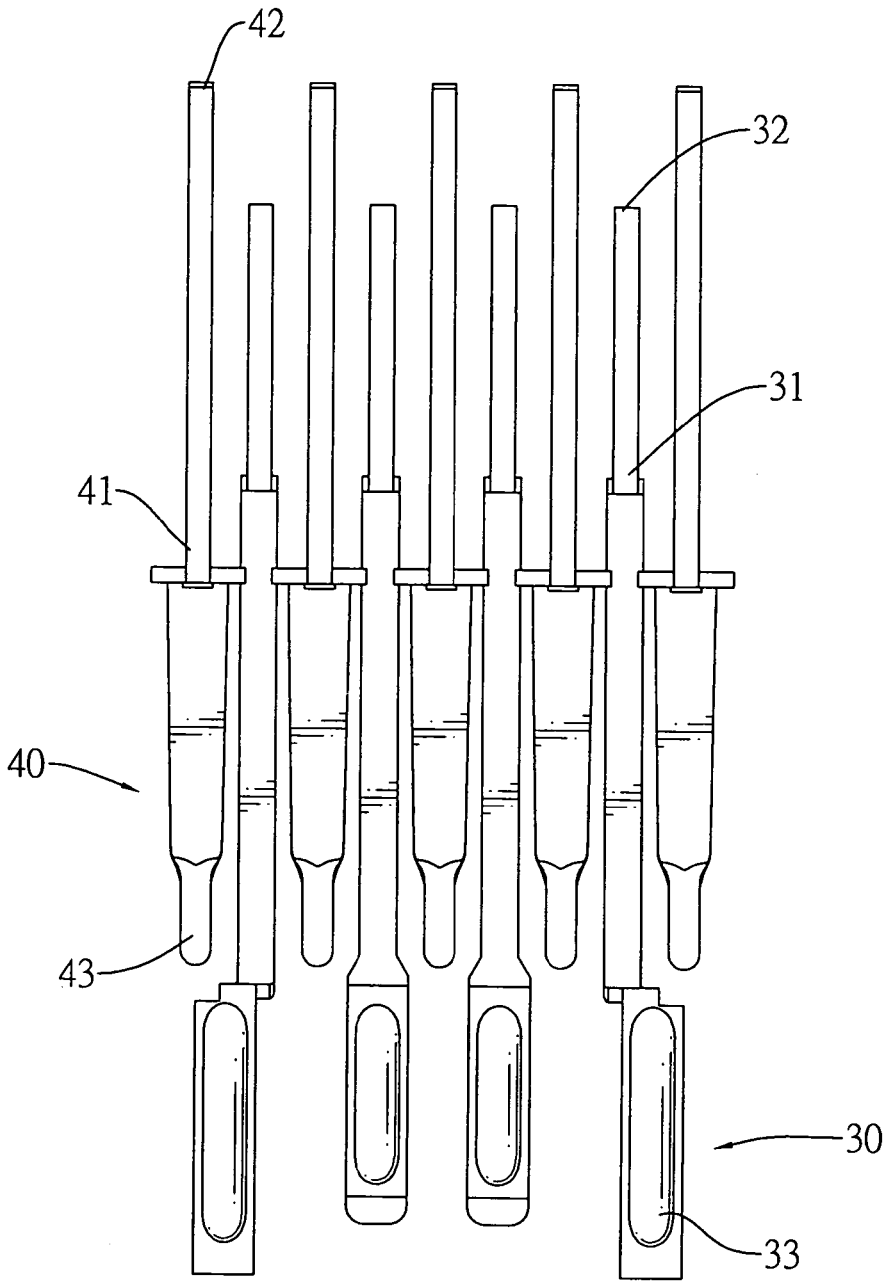
FIG. 7 is a top view of the first and second terminals of the plug connector in FIG. 6A.
Figure 8:
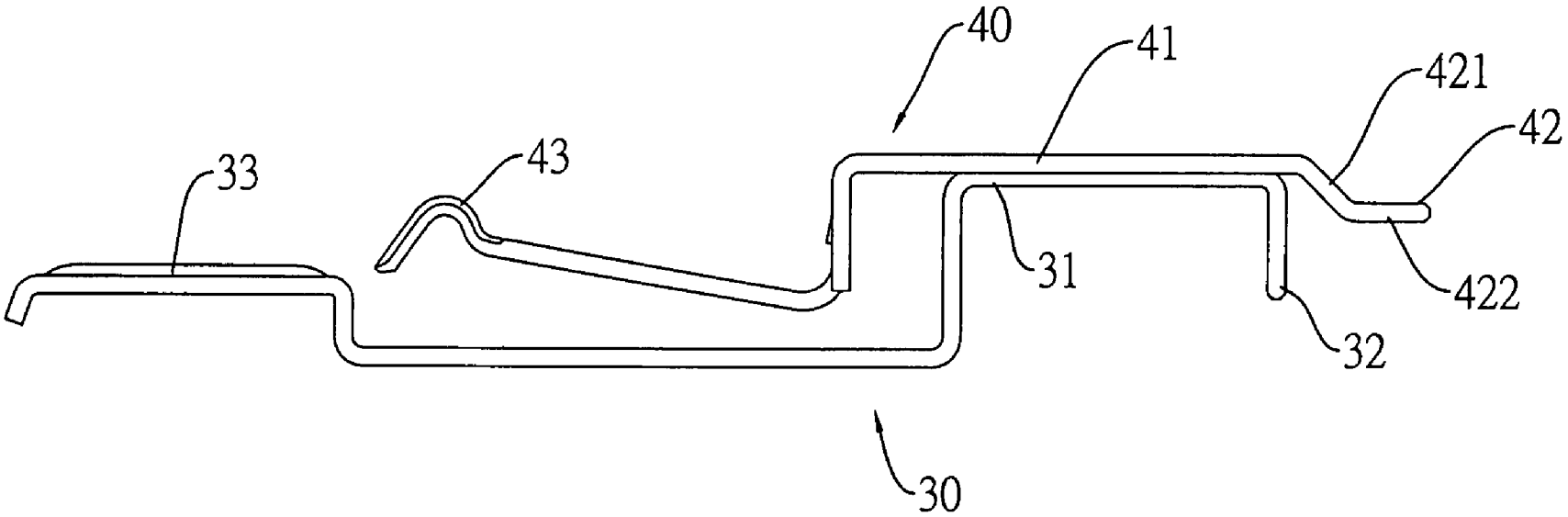
FIG. 8 is a side view of the first and second terminals of the plug connector in FIG. 6A.

With reference to FIG. 6B, a second embodiment of the plug connector in accordance with the present invention has the soldering sections (32, 42*a*) of the first and second terminals (30, 40*a*) being THE type and straight.

Figure 9A:
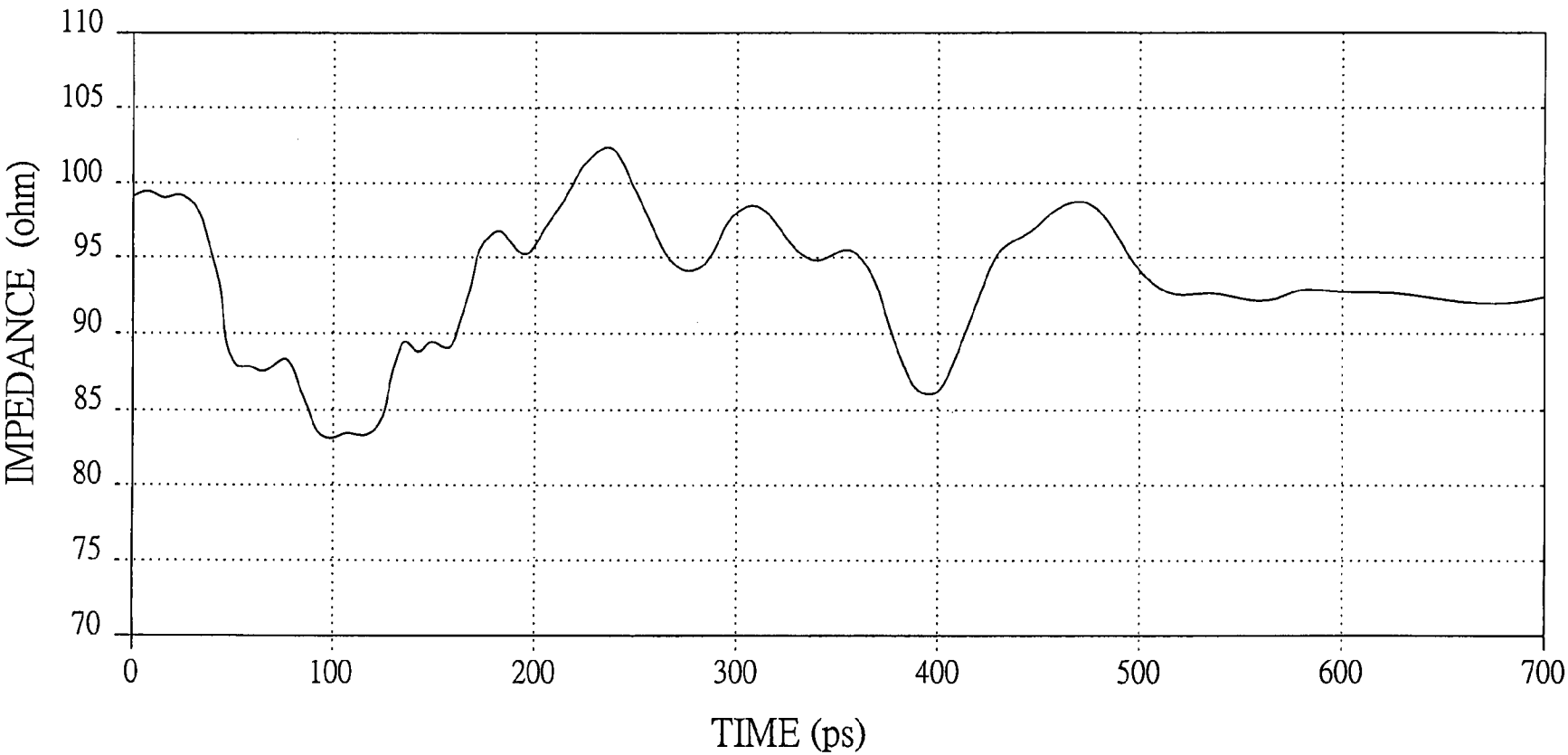
FIG. 9A is a plot of impedance against time for the first embodiment of the plug connector in FIG. 1.

With further reference to FIG. 9A, a plot of impedance against time shows a curve indicating impedance of the first embodiment of the plug connector of the first embodiment during signal transmission. The unit of impedance is "ohm" and that of the time is "$10^{-12}$ second (Pico-second, ps)". As indicated by the curve, when signal transmission is implemented, maximum and minimum impedance values of the first embodiment are 103 and 83 ohm and are within acceptable standards for USB 3.0 plug connectors by having a range of 75 to 105 ohms. Therefore, advantages of the first embodiment of the plug connector include stable high frequency signal transmission.

Figure 9B:
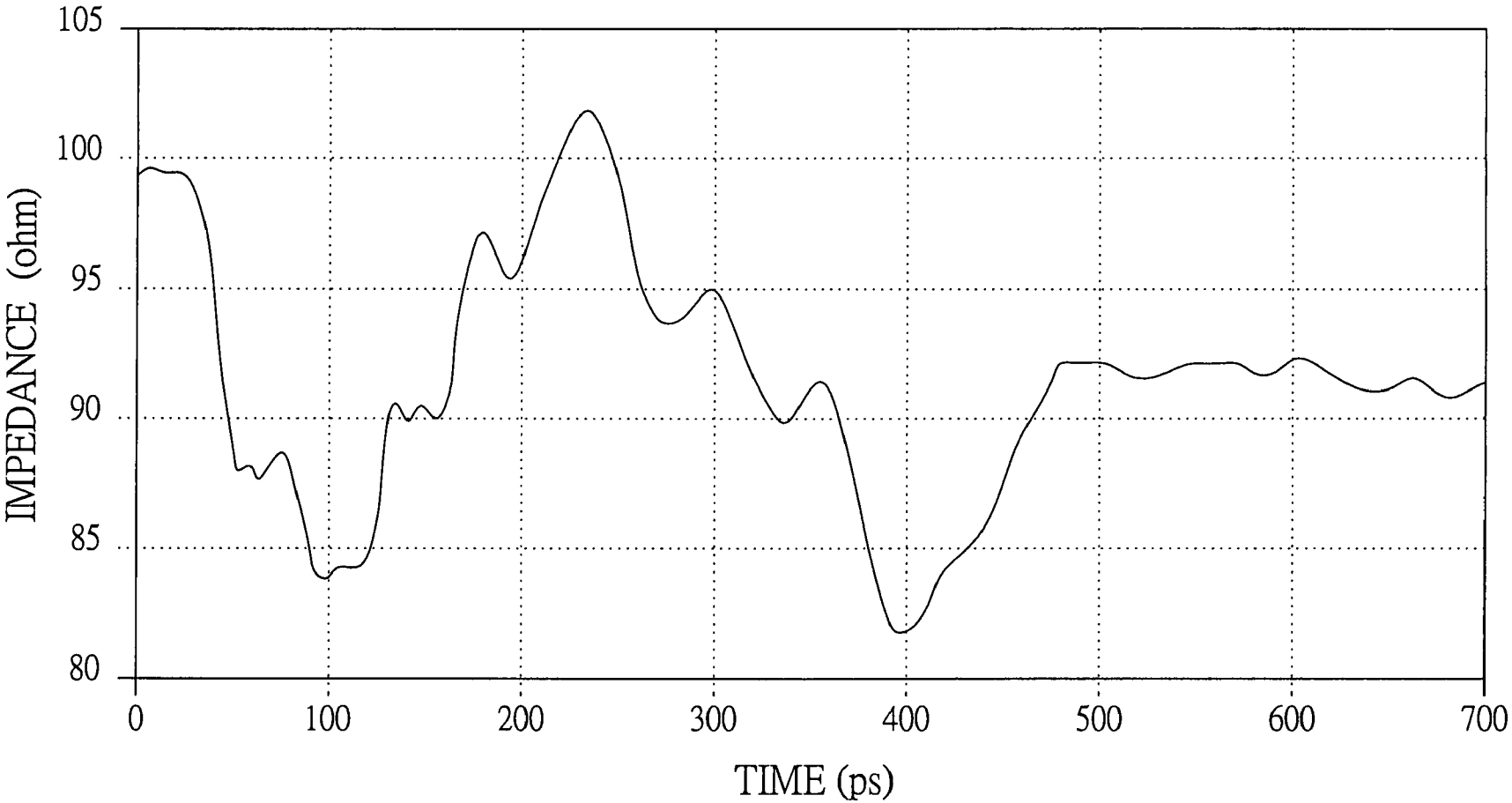
FIG. 9B is a plot of impedance against time for the second embodiment of the plug connector in FIG. 6B.

With further reference to FIG. 9B, a plot of impedance against time shows a curve indicating impedance of the second embodiment of the plug connector of the second embodiment during signal transmission. As indicated by the curve, when signal transmission is implemented, maximum and minimum impedance values of the second embodiment are 101.9 and 81.81 ohm and are within the aforementioned acceptable standards. Therefore, advantages of the second embodiment include stable high frequency signal transmission.

The present invention has the following advantages.

1. The soldering sections (32, 42, 42*a*) of the first and second terminals (30, 40, 40*a*) are arranged in different transverse rows (T1, T2) so that the density of the soldering section layout is reduced to facilitate a soldering process. During the soldering process, when excess solder is applied to each soldering section (32, 42, 42*a*) such solder does not easily overflow to nearby soldering sections (32, 42, 42*a*), which prevents shorting problems.

2. The insulative housing (10) and mounting bracket (20) are separate components instead of being formed together so that designing and manufacturing a mold for each component is easy and cheap when compared to a structurally complicated mold for molding a one-piece insulative housing holding all terminals of a conventional connector. Thus, manufacturing costs of the plug connector are lowered.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A plug connector comprising:

an insulative housing;

a mounting bracket formed as a separate component from the insulative housing and is mounted on the insulative housing;

multiple first terminals mounted through the insulative housing and each first terminals having a mounting section mounted in the insulative housing;

a soldering section formed on and protruding downward from the mounting section and the soldering sections of the first terminals arranged in a first transverse row relative to the insulative housing; and a contacting section formed on and protruding forward from the mounting section;

multiple second terminals mounted through the mounting bracket and each second terminal having a mounting section mounted in the mounting bracket;

a soldering section formed on and protruding downward from the mounting section, the soldering sections of the second terminals arranged in a second transverse row relative to the insulative housing and the first transverse row disposed closer to the rear end of the base of the insulative housing than the second transverse row; and a contacting section formed on and protruding forward from the mounting section; and a shell covering the insulative housing, mounting bracket, first terminals and second terminals.

2. The plug connector as claimed in claim 1, wherein the first terminals are capable of implementing USB 2.0 signal transmission; and the second terminals are capable of cooperating with the first terminals to implement USB 3.0 signal transmission.

3. The plug connector as claimed in claim 1, wherein the insulative housing has a base having a top, a bottom, a front end and a rear end; and a tongue formed on and protruding forward from the front end;

the mounting bracket has a mount having a rear end; and an extension member formed on and protruding backward from the rear end of the mount and has a top surface and a bottom surface; and the soldering sections of the first terminals extend out of the rear end of the base and the contacting sections of the first terminals are mounted on the tongue.

4. The plug connector as claimed claim 3, wherein the base of the insulative housing further has a mounting slot defined in the top of the base; and the mount of the mounting bracket is mounted in the mounting slot.

5. The plug connector as claimed in claim 3, wherein the base of the insulative housing further has multiple first engaging elements formed on the top of the base; and the extension member of the mounting bracket further has multiple second engaging elements formed on the bottom surface of the extension member and respectively engaging the first engaging elements.

6. The plug connector as claimed in claim 5, wherein the first engaging elements are multiple first notches and multiple first ribs; and the second engaging elements are multiple second notches and multiple second ribs respectively engaging the first notches and ribs of the insulative housing.

7. The plug connector as claimed in claim 3, wherein the extension member of the mounting bracket further has a fastening protrusion formed on and protruding upward from the top surface of the extension member; and the shell has a top panel having a rear end and a fastening slot defined in the rear end and engaging the fastening protrusion;

two opposite side panels formed on and protruding down from the top panel; and a bottom panel formed between the side panels.

8. The plug connector as claimed in claim 1, wherein the soldering section of second first terminal is THE type and straight; and the soldering section of each second terminal is SMT type and substantially L-shaped and has an inclined segment protruding obliquely downward from the mounting section of the second terminal; and a level segment protruding horizontally backward from the inclined segment.

9. The plug connector as claimed in claim 1, wherein the soldering sections of the first and second terminals are THE type and straight.

10. The plug connector as claimed in claim 3, wherein the insulative housing further has multiple mounting posts formed on the bottom of the base.

11. The plug connector as claimed in claim 1, wherein first terminals are mounted through the insulative housing by an insert-molding process.

12. The plug connector as claimed in claim 1, wherein the second terminals are mounted through the mounting bracket by an insert-molding process.

* * * * *